US012789031B2

(12) United States Patent
Patterson

(10) Patent No.: US 12,789,031 B2
(45) Date of Patent: Nov. 10, 2026

(54) PULL UP BAR SYSTEM WITH SHOCK ABSORBER

(71) Applicant: Mark Allen Patterson, Bloomdale, OH (US)

(72) Inventor: Mark Allen Patterson, Bloomdale, OH (US)

(73) Assignee: LEOSTAR FITNESS LLC, Findlay, OH (US)

( * ) Notice: Subject to any disclaimer, the term of this patent is extended or adjusted under 35 U.S.C. 154(b) by 59 days.

(21) Appl. No.: 19/177,511

(22) Filed: Apr. 12, 2025

(65) Prior Publication Data

US 2025/0319342 A1 Oct. 16, 2025

Related U.S. Application Data

(60) Provisional application No. 63/633,755, filed on Apr. 13, 2024.

(51) Int. Cl.
*A63B 1/00* (2006.01)

(52) U.S. Cl.
CPC ..... *A63B 1/00* (2013.01); *A63B 2208/029* (2013.01); *A63B 2209/00* (2013.01); *A63B 2225/093* (2013.01)

(58) Field of Classification Search
CPC ... A63B 1/00; A63B 21/00047; A63B 21/068; A63B 21/16; A63B 21/1618; A63B 21/169; A63B 21/4035; A63B 22/0046; A63B 23/1218; A63B 71/0036; A63B 71/0054; A63B 2071/0063; A63B 2071/0072; A63B 2208/029; A63B 2209/00; A63B 2210/00; A63B 2210/50; A63B 2225/093
See application file for complete search history.

(56) References Cited

U.S. PATENT DOCUMENTS

| | | | | |
|---|---|---|---|---|
| 2,988,122 A | | 6/1961 | Stevens | |
| 3,170,214 A | | 2/1965 | Downie | |
| 3,342,484 A | * | 9/1967 | Christensen | A63B 1/005 482/40 |
| D309,094 S | | 7/1990 | Donis | |
| 5,056,385 A | | 10/1991 | Petersen | |

(Continued)

FOREIGN PATENT DOCUMENTS

WO WO-2024105540 A1 * 5/2024 ..... A63B 4/00

OTHER PUBLICATIONS

DreamGYM ("Doorway Pull-up Bar / Chin-up Bar," dated Nov. 27, 2020, https://kidsdreamgym.com/collections/doorway-bar/products/doorway-pull-up-bar-chin-up-bar (Year: 2020).*

*Primary Examiner* — Gary D Urbiel Goldner

(57) ABSTRACT

An exercise system for pull up exercises can include a bar, a first block, a first support bracket, and a first u-shaped pocket member. The bar can have a first bar end and a second bar end. The first block can be coupled to the first bar end, and the first block can contain a shock absorbing non-metal material. The first u-shaped pocket member can protrude from the first support bracket. The first u-shaped pocket member can be configured to at least partially mate with the first block such that when the first block slidably fits into the first u-shaped pocket member, the first block is restricted from rotating within the first u-shaped pocket member.

24 Claims, 11 Drawing Sheets

(56) References Cited

U.S. PATENT DOCUMENTS 5,180,350 A * 1/1993 Thomas ..... A63B 1/00 482/40
D350,469 S 9/1994 Sawdon
5,389,055 A * 2/1995 Gangloff ..... A63B 21/4045 482/142
5,527,242 A * 6/1996 Gangloff ..... A63B 21/4045 482/141
5,569,123 A * 10/1996 Creatchman ..... A63B 21/00047 482/40
5,662,556 A * 9/1997 Gangloff ..... A63B 1/005 482/17
D439,487 S 3/2001 Renner
D455,310 S 4/2002 Webber
D469,293 S 1/2003 Harms
6,893,012 B2 5/2005 Wong
6,932,335 B1 8/2005 Dykstra
D541,613 S 5/2007 Wang
7,244,186 B2 7/2007 Hauck
D550,793 S 9/2007 Rogers
D554,209 S 10/2007 Loucks
D564,865 S 3/2008 Johnson
7,338,416 B2 3/2008 Smith
7,472,632 B2 1/2009 Engvall
D594,317 S 6/2009 Anthony
7,625,290 B2 12/2009 Hodjat
D633,156 S 2/2011 Caswell
7,878,492 B2 2/2011 Dykstra
8,123,205 B2 2/2012 Martin
D682,955 S 5/2013 Stephan
D721,266 S 1/2015 Sun
9,044,629 B2 6/2015 Ross
D734,410 S 7/2015 Childs
9,333,387 B2 5/2016 Hopperstad
D764,607 S 8/2016 Beckford
9,427,612 B1 * 8/2016 Swanson ..... A63B 1/00
9,452,308 B2 9/2016 Lentz
9,630,046 B2 4/2017 Childs
9,694,233 B2 7/2017 Chou
D795,684 S 8/2017 Cacciabeve
D805,884 S 12/2017 Evitt
D805,885 S 12/2017 Karmarkar
D812,108 S 3/2018 Jones
D812,725 S 3/2018 Sato
D815,516 S 4/2018 Karmarkar
D830,809 S 10/2018 Kuo
D844,419 S 4/2019 West
D852,289 S 6/2019 Jones
D854,635 S 7/2019 Dunahay
D859,968 S 9/2019 West
D871,309 S 12/2019 Adler
D882,288 S 4/2020 Liu
D884,095 S 5/2020 Dunahay
D884,096 S 5/2020 Dunahay
D898,879 S 10/2020 Kalb
D907,725 S 1/2021 Adams
D911,466 S 2/2021 Dunahay
11,033,771 B2 6/2021 Juen
D934,667 S 11/2021 Oggier
D945,540 S 3/2022 Pritchett
D968,535 S 11/2022 Wang
11,529,549 B2 12/2022 Henniger
D1,010,037 S 1/2024 Sorin
2011/0190098 A1 * 8/2011 Griswold ..... A63B 21/023 482/40
2014/0323275 A1 * 10/2014 Moses, II ..... A63B 21/1627 482/40
2020/0114197 A1 * 4/2020 McGhee ..... A63B 21/4033
2022/0023715 A1 * 1/2022 Brink ..... A63B 23/1218
2022/0062690 A1 * 3/2022 Markowski ..... A63B 21/1627
2023/0141103 A1 * 5/2023 Christiansen ..... A61H 1/02 601/5
2024/0359047 A1 * 10/2024 Sharp ..... A63B 21/1627
2026/0175078 A1 * 6/2026 Park ..... A63B 1/00

* cited by examiner

PULL UP BAR SYSTEM WITH SHOCK ABSORBER

TECHNICAL FIELD OF THE INVENTION

The present disclosure relates generally to exercise equipment and systems.

BACKGROUND OF THE INVENTION

Generally, performing exercises with a pull up bar has long been a mainstay of fitness programs. Pull up bar exercises can include, but are not necessarily limited to, pull-ups, chin-ups, chest to bar, bar muscle-ups and toes to bar, among others, for example. Typically, a pull up bar includes a bar that is positioned horizontally. The bar is grasped by the hands while performing exercises. Such bars are typically coupled to support arms, support members, or other structures that suspend and support the bar therebetween.

In many instances, the bar is welded to the support structures. As such, the bar is essentially permanently coupled to the support structures. In other instances, the bar is coupled to the support structures with threaded fasteners. Generally, tools are required to install or remove the fasteners.

Performing exercises on a pull up bar can cause significant forces to muscles, connective tissues, and joints of the person performing the exercise. Areas of the body affected by such exercises include, but are not limited to, hands, arms, shoulders, back and neck.

Pull up bar systems with rigid mounts do not absorb and do not dampen forces to the body of the person performing the exercise. The person must absorb and dampen all of the forces generated by the exercise movement. The person performing the exercise, can incur fatigue, strain, and injury due to such forces.

Pull up bar systems with rigid mounts do not allow the pull up bar to rotate. While many exercises are performed best on a pull up bar that does not rotate, some exercises can be performed with less fatigue, strain, and injury on a pull up bar that rotates.

Pull up bar systems with welded mounts are rigid and do not allow bars to be changed easily. Pull up bar systems with fasteners that require tools to install or remove are rigid and do not allow bars to be changed easily.

SUMMARY OF THE INVENTION

In an embodiment of the present disclosure, an exercise system can include: a bar having a first bar end and a second bar end; a first block coupled to the first bar end, the first block containing a first shock absorbing non-metal material; a first support bracket; and a first u-shaped latch assembly protruding from the first support bracket, where the first u-shaped latch assembly is configured to at least partially mate with the first block such that when the first block slidably fits into the first u-shaped latch assembly, the first block is restricted from rotating within the first u-shaped latch assembly.

In an embodiment of the present disclosure, an exercise system can include: a bar having a first-side bar end and a second-side bar end; a first-side block coupled to the first-side bar end, the first-side block containing a shock absorbing non-metal material; a first-side support bracket; a first first-side u-shaped latch assembly protruding from the first-side support bracket, where the first first-side u-shaped latch assembly is configured to at least partially mate with the first-side block such that when the first-side block slidably fits into the first first-side u shaped latch assembly, the first-side block is restricted from rotating within the first first-side u-shaped latch assembly; and a second first-side u-shaped latch assembly protruding from the first-side support bracket, where the second first-side u-shaped latch assembly is configured to at least partially mate with the first-side block such that when the first-side block slidably fits into the second first-side u-shaped latch assembly, the first-side block is restricted from rotating within the second first-side u-shaped latch assembly.

In an embodiment of the present disclosure, an exercise system can include: a bar having a first bar end and a second bar end; a first block coupled to the first bar end, the first block containing a shock absorbing non-metal material; a first support bracket; and a first u-shaped pocket member protruding from the first support bracket, where the first u-shaped pocket member is configured to at least partially mate with the first block such that when the first block slidably fits into the first u-shaped pocket member, the first block is restricted from rotating within the first u-shaped pocket member.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE DRAWINGS

Figure 1:
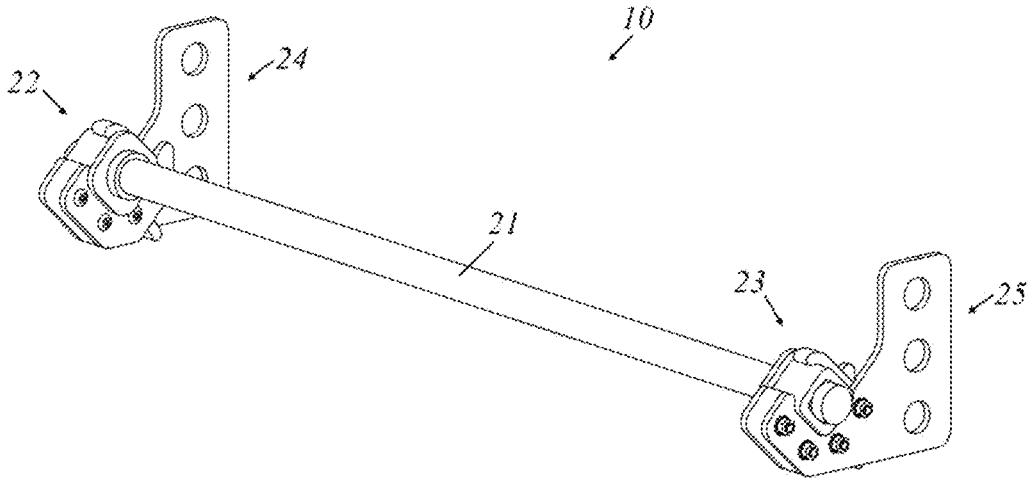
FIG. 1 is a perspective view of a pull up bar system incorporating a shock absorbing mount according to an embodiment of the present disclosure.

Referring now to the drawings, in which like reference numbers can be used herein to designate like or similar elements throughout the various views, illustrative and example embodiments are shown and described. The figures are not necessarily drawn to scale, and in some instances the drawings can be exaggerated or simplified in places for illustrative purposes. One of ordinary skill in the art can appreciate many possible applications and variations for other embodiments based on the following illustrative and example embodiments provided in the present disclosure.

In the present disclosure, terms such as "first", "second", and the like, may be used to describe various components, but the components are not necessarily limited by such terms, for example, regarding nature, order, sequence, importance, or number of such components possible in an embodiment. Such terms can be used merely for the purpose of distinguishing one component from other components in a given embodiment or group of embodiments. For example, a first component may be referred to as a second component, and similarly, a second component may also be referred to as a first component without departing from the scope of rights according to the present disclosure.

In the present disclosure, certain elements may be discussed as, referred to, and actually be plural, but can be only shown as a singular example in the drawings, even though that single example is among a set of a plurality. Similarly, certain elements may be discussed, referred to, and shown as singular, but may be plural or may be part of a set of a plurality of the same, unless expressly stated otherwise. In the present disclosure, a detailed description of a right side component may be provided while a corresponding detailed description of a left side component is not provided, which can be because in some of the example embodiments shown and described in the present disclosure, a left side component/system/device can be the same as or mirror symmetrical to the corresponding right side component/system/device and another description and/or exploded view would be unnecessarily duplicative or repetitive, as can be apparent to one of ordinary skill in the art to which the present disclosure pertains.

Some embodiments of the present disclosure can provide a pull up bar system incorporating an elastomer mount in the pull up bar system.

Some embodiments of the present disclosure can provide an improvement to current pull up bar system constructions. More specifically, some embodiments of the present disclosure can provide a pull up bar system that can absorb and dampen forces generated by exercise movements. Some embodiments of the present disclosure can provide a pull up bar system that can limit rotation of the pull up bar or allow full rotation of the pull up bar. Some embodiments of the present disclosure can provide a pull up bar system that can allow the pull up bar to be coupled and uncoupled from the support structures without tools.

In some embodiments of the present disclosure, a pull up bar system can include an elastomer mount that couples a pull up bar to support structures. In some embodiments of the present disclosure, the elastomer mount can absorb and dampen some of the forces generated by exercise movements. In some embodiments of the present disclosure, the mount can be constructed to limit rotation of the pull up bar or allow full rotation of the pull up bar. In some embodiments of the present disclosure, the mount and support structure can be constructed to allow the pull up bar to be coupled and uncoupled from the support structure without the use of tools.

Elastomers can be rubber-like solids with elastic properties. In some embodiments, elastomer mounts can be used to couple pull up bars to support structures. In some embodiments, elastomer mounts in a pull up bar system can absorb and dampen some of the forces generated by exercise movements. In some embodiments, elastomer mounts can be used to couple pull up bars to support structures and uncouple pull up bars from support structures without the need for tools. In some embodiments, elastomer mounts can be made from a single material with a specific hardness or from a combination of two or more materials with the same hardness or different hardnesses.

In some embodiments of the present disclosure, the pull up bar can be coupled to the mount in such a way to not allow the bar to rotate. In some embodiments of the present disclosure, the pull up bar can be coupled to the mount in such a way to allow the bar to rotate a specific range of degrees. In some embodiments of the present disclosure, the pull up bar can be coupled to the mount in such a way to allow the bar to rotate a full 360 degrees.

Next some specific example embodiments of the present disclosure will be described to illustrate various features and advantages that can be incorporated into an embodiment of the present disclosure. Different and various components and features of these example embodiments can be mixed in different combinations to form other embodiments of the present disclosure.

FIG. 1 is a perspective view of a pull up bar system incorporating a shock absorbing mount according to an embodiment of the present disclosure.

A pull up bar system 10 can include a pull up bar 21, a left elastomer mount assembly 22, a right elastomer mount assembly 23, a left support assembly 24 and a right support assembly 25.

The left support assembly 24 and the right support assembly 25, can be attachable to an outside surface, such as, but not necessarily limited to, a rig, a rack, a cross member, a wall, a column, among others, for example.

A left end of the pull up bar 21 can be coupled with the left elastomer mount assembly 22. A right end of the pull up bar 21 can be coupled with the right elastomer mount assembly 23. In this embodiment, the pull up bar 21 can be restricted from rotating relative to the elastomer mount assemblies 22, 23.

Referring to FIG. 1, the left elastomer mount assembly 22 can be coupled with the left support assembly 24, and the right elastomer mount assembly 23 can be coupled with the right support assembly 25. In this embodiment, the elastomer mount assemblies 22, 23 can be coupled to the support assemblies 24, 25, in each of four rotational positions.

Figure 2:
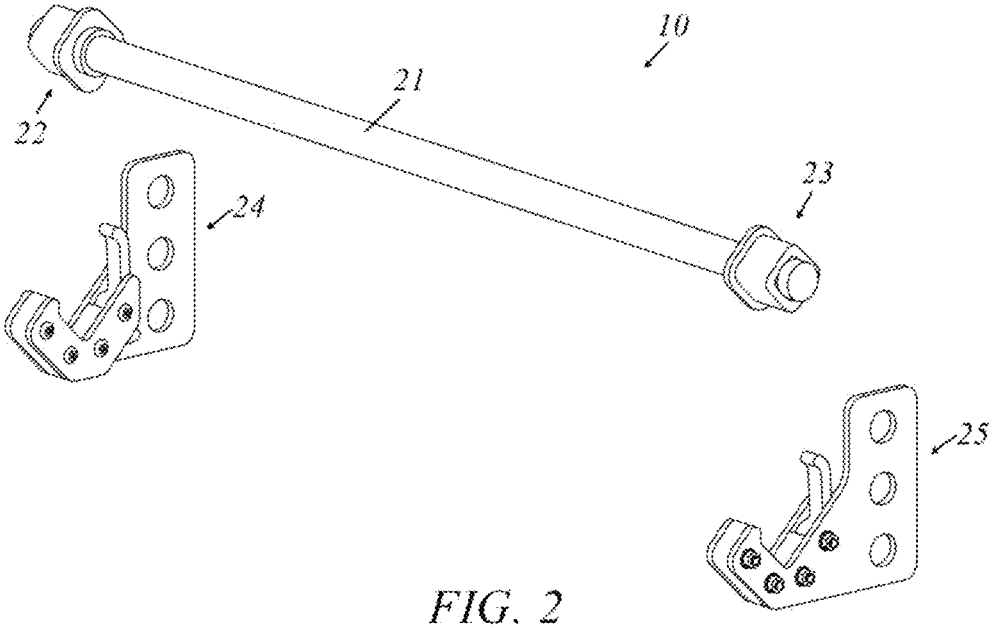
FIG. 2 is an exploded perspective view of the pull up bar system of FIG. 1, according to an embodiment of the present disclosure.

FIG. 2 is an exploded perspective view of the pull up bar system 10 of FIG. 1, according to an embodiment of the present disclosure.

Referring to FIG. 2, the left elastomer mount assembly 22 can be uncoupled from the left support assembly 24, and the right elastomer mount assembly 23 can be uncoupled from the right support assembly 25.

Figure 3:
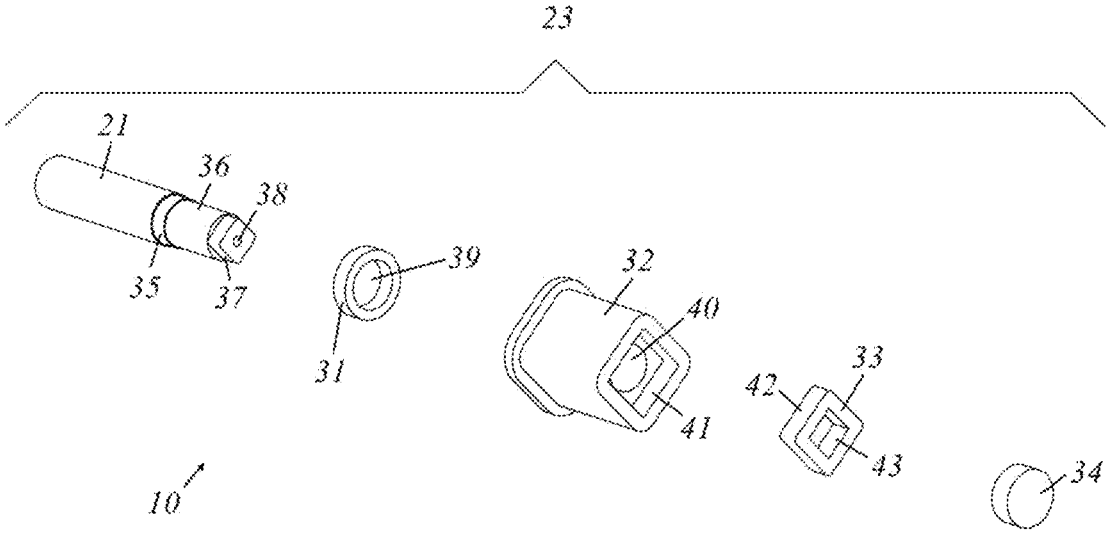
FIG. 3 is an exploded perspective view of a right side portion of the pull up bar system of FIG. 1, according to an embodiment of the present disclosure.
Figure 4:
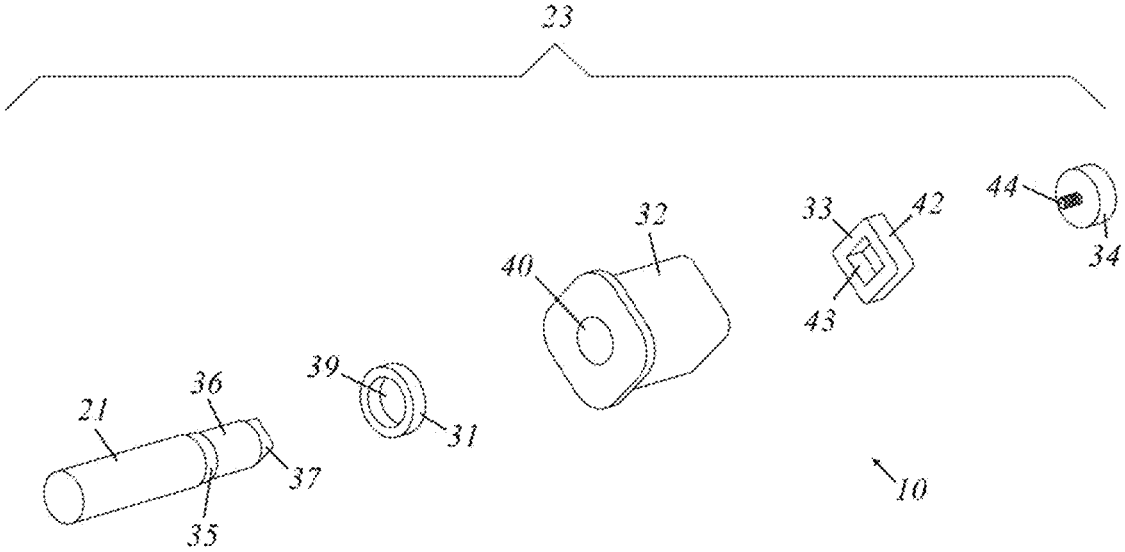
FIG. 4 is an exploded perspective view of a right side portion of the pull up bar system of FIG. 1, according to an embodiment of the present disclosure.

FIG. 3 is an exploded perspective view of a right side portion of the pull up bar system 10 of FIG. 1, according to an embodiment of the present disclosure. FIG. 4 is another exploded perspective view of a right side portion of the pull up bar system 10 of FIG. 1, according to an embodiment of the present disclosure.

The pull up bar system 10 can include a collar 31, an elastomer block 32, a hub 33 and a thumbscrew fastener 34. The right end of the pull up bar 21 can include an area 35, an area 36, an area 37, and a threaded hole 38. The collar 31 can include an opening 39. The elastomer block 32 can include an opening 40 and a cavity portion 41. The hub 33 can include an outer surface area 42 and an opening 43.

The right end of the pull up bar 21 can be slidably extended through the opening 39 of the collar 31. The collar 31 can be coupled to the area 35 of the pull up bar 21.

The right end of the pull up bar 21 can be slidably extended through the opening 40 of the elastomer block 32. The elastomer block 32 can be coupled to the area 36 of the pull up bar 21.

The right end of the pull up bar 21 can be slidably extended through the opening 43 of the hub 33. The hub 33 can be coupled to the area 37 of the pull up bar 21. The hub 33 can be slidably extended into the cavity portion 41 of the elastomer block 32. The thumbscrew fastener 34 can be threaded into the threaded hole 38 of the pull up bar 21. The hub 33 can couple the pull up bar 21 with the elastomer block 32 to restrict lateral movement and restrict rotational movement of the pull up bar 21 relative to the elastomer block 32.

The thumbscrew fastener 34 can include an external threaded portion 44.

Figure 5:
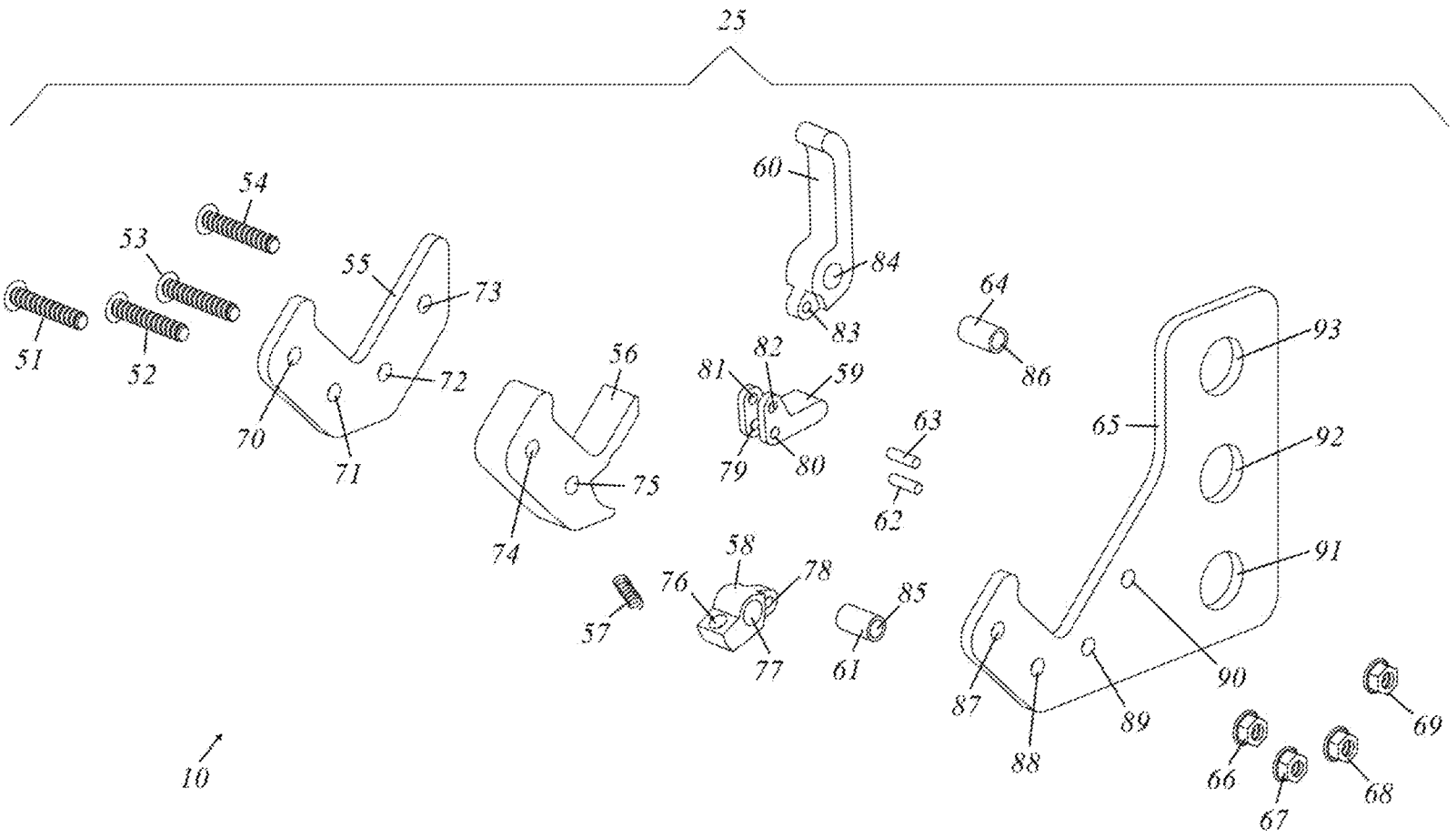
FIG. 5 is an exploded perspective view of a right side portion of the pull up bar system of FIG. 1, according to an embodiment of the present disclosure.

FIG. 5 is an exploded perspective view of a right side portion of the pull up bar system 10 of FIG. 1, according to an embodiment of the present disclosure.

The right support assembly 25 can include a threaded screw fastener 51, a threaded screw fastener 52, a threaded screw fastener 53, a threaded screw fastener 54, an outer v-shaped member 55, a middle v-shaped member 56, a compression spring 57, a clamp spring pivot 58, a clamp lever 59, a clamp arm 60, a bushing 61, a dowel pin 62, a dowel pin 63, a bushing 64, a support bracket 65, a threaded nut fastener 66, a threaded nut fastener 67, a threaded nut fastener 68, and a threaded nut fastener 69.

The outer v-shaped member 55 can include an opening 70, an opening 71, an opening 72, and an opening 73. The middle v-shaped member 56 can include an opening 74 and an opening 75. The clamp spring pivot 58 can include a cavity portion 76, an opening 77, and an opening 78. The clamp lever 59 can include an opening 79, an opening 80, an opening 81, and an opening 82. The clamp arm 60 can include an opening 83 and an opening 84. The bushing 61 can include an opening 85. The bushing 64 can include an opening 86. The support bracket 65 can include an opening 87, an opening 88, an opening 89, an opening 90, an opening 91, an opening 92, and an opening 93.

The openings 91-93 can enable the support bracket 65 to be attachable to an outside surface, such as, but not necessarily limited to, a rig, a rack, a cross member, a wall, a column, among others, for example.

The compression spring 57, the clamp spring pivot 58, the clamp lever 59, the clamp arm 60, the bushings 61, 64, and the dowel pins 62, 63 can be coupled together to form an over-center clamp mechanism. The bushing 61 can be slidably extended through the opening 77. The bushing 64 can be slidably extended through the opening 84. The opening 78 can be sandwiched between the opening 79 and the opening 80, such that the dowel pin 62 can be slidably extended through the openings 78-80. The opening 83 can be sandwiched between the opening 81 and the opening 82, such that the dowel pin 63 can be slidably extended through the openings 81-83. A first end of the compression spring 57 can be slidably extended into the cavity portion 76. A second end of the compression spring 57 can extend onto a bottom area of the middle v-shaped member 56.

The outer v-shaped member 55, the middle v-shaped member 56, the bushing 61, the clamp spring pivot 58, the bushing 64, the clamp arm 60, and the support bracket 65 can be coupled together with the threaded fasteners 51, 52, 53, 54, 66, 67, 68, and 69. The threaded screw fastener 51 can be slidably extended through the openings 70, 74, and 87. The threaded screw fastener 52 can be slidably extended through the openings 71, 75, and 88. The threaded screw fastener 53 can be slidably extended through the openings 72, 85, and 89. The threaded screw fastener 54 can be slidably extended through the openings 73, 86, and 90. The threaded nut fastener 66 can be threaded onto the threaded screw fastener 51. The threaded nut fastener 67 can be threaded onto the threaded screw fastener 52. The threaded nut fastener 68 can be threaded onto the threaded screw fastener 53. The threaded nut fastener 69 can be threaded onto the threaded screw fastener 54.

Figure 6:
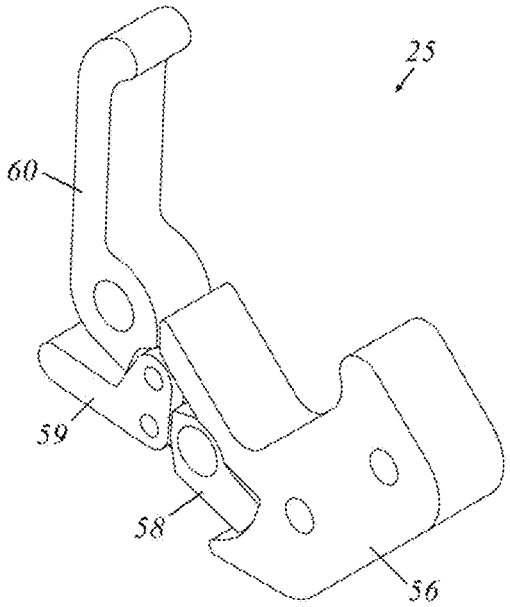
FIG. 6 is a perspective view of a right side portion of the pull up bar system of FIG. 1, according to an embodiment of the present disclosure.

FIG. 6 is a perspective view of a right side portion of the pull up bar system 10 of FIG. 1, according to an embodiment of the present disclosure. Referring to FIG. 6, the over-center clamp mechanism of the right support assembly 25, can form an open position.

Figure 7:
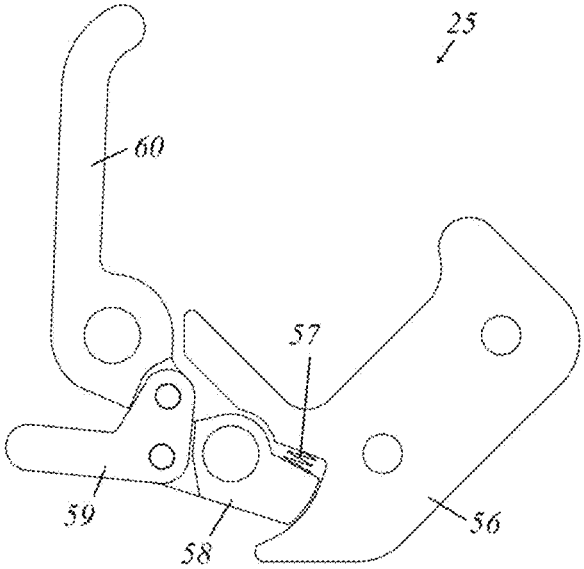
FIG. 7 is a side view of a right side portion of the pull up bar system of FIG. 1, according to an embodiment of the present disclosure.

FIG. 7 is a side view of a right side portion of the pull up bar system 10 of FIG. 1, according to an embodiment of the present disclosure. Referring to FIG. 7, the over-center clamp mechanism of the right support assembly 25, can form an open position.

Figure 8:
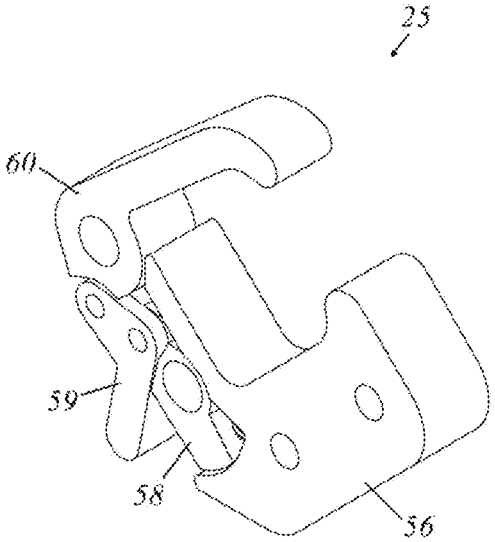
FIG. 8 is a perspective view of a right side portion of the pull up bar system of FIG. 1, according to an embodiment of the present disclosure.

FIG. 8 is a perspective view of a right side portion of the pull up bar system 10 of FIG. 1, according to an embodiment of the present disclosure. Referring to FIG. 8, the over-center clamp mechanism of the right support assembly 25, can form a closed position.

Figure 9:
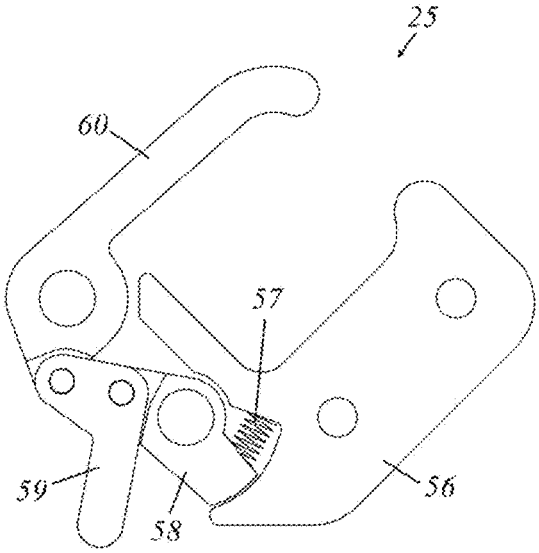
FIG. 9 is a side view of a right side portion of the pull up bar system of FIG. 1, according to an embodiment of the present disclosure.

FIG. 9 is a side view of a right side portion of the pull up bar system 10 of FIG. 1, according to an embodiment of the present disclosure. Referring to FIG. 9, the over-center clamp mechanism of the right support assembly 25, can form a closed position.

The over-center clamp mechanism can be moveable to form an open position (see, e.g., FIGS. 6-7) and the over-center clamp mechanism can be moveable to form a closed position (see, e.g., FIGS. 8-9). In the open position, the right support assembly 25 can receive the right elastomer mount assembly 23. In the closed position, the right elastomer mount assembly 23 can be coupled to the right support assembly 25 with a clamping force. In the open position, a force of the compression spring 57 can act on the clamp spring pivot 58 to form a retaining mechanism to retain the over-center clamp mechanism in the open position. In the closed position, a force of the compression spring 57 can act on the clamp spring pivot 58 to form a retaining mechanism to retain the over-center clamp mechanism in the closed position.

Figure 10:
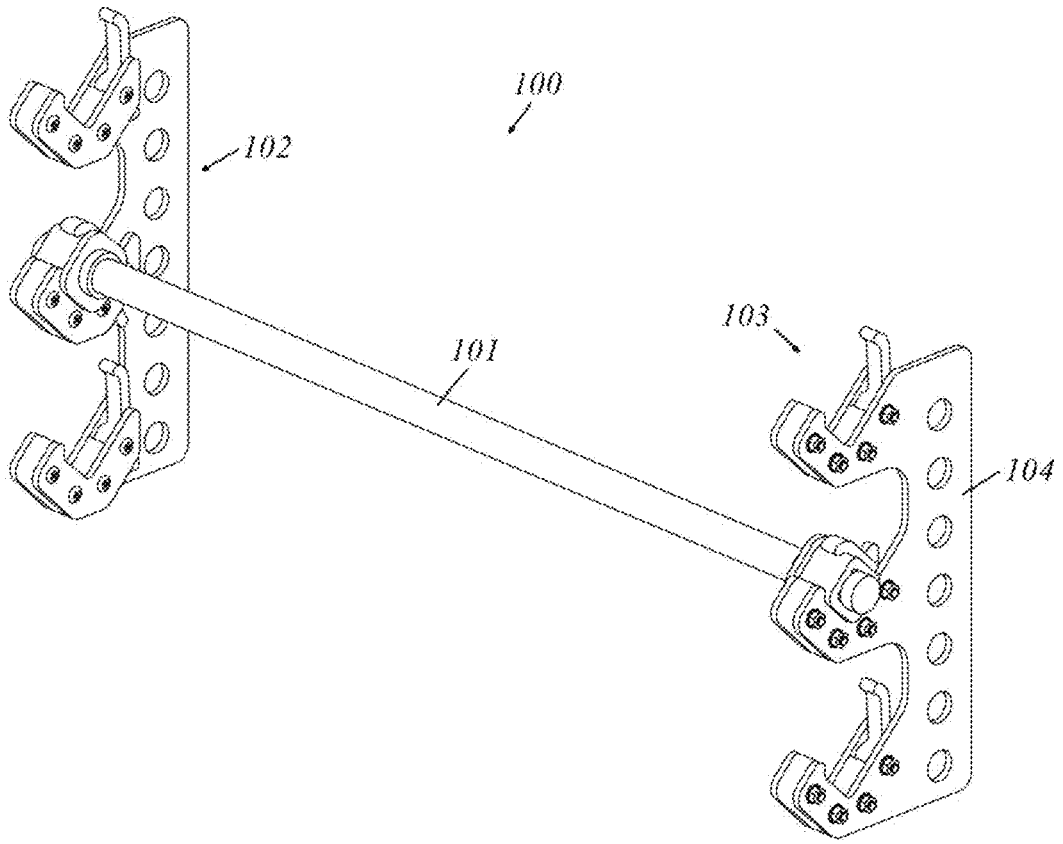
FIG. 10 is a perspective view of a pull up bar system incorporating a shock absorbing mount according to an embodiment of the present disclosure.
Figure 11:
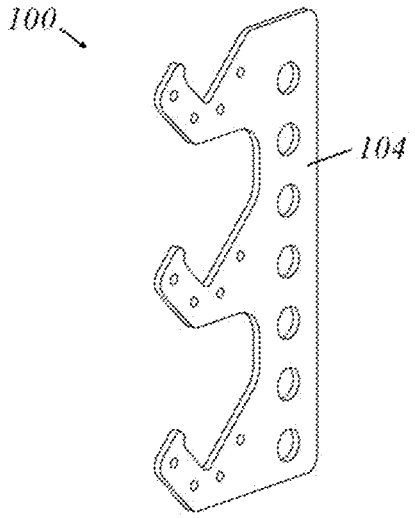
FIG. 11 is a perspective view of the right support bracket of the pull up bar system of FIG. 10, according to an embodiment of the present disclosure.

FIG. 10 is a perspective view of a pull up bar system incorporating a shock absorbing mount according to an embodiment of the present disclosure. FIG. 11 is a perspective view of the right support bracket 104 of the right support assembly 103 of the pull up bar system 100 of FIG. 10, according to an embodiment of the present disclosure.

A pull up bar system 100 can include a pull up bar 101, a left support assembly 102, and a right support assembly 103. The right support assembly 103 can include a right support bracket 104. The right support bracket 104 of FIG. 10 is shown in a perspective view in FIG. 11.

The left support assembly 102 and the right support assembly 103 can be attachable to an outside surface, such as, but not necessarily limited to, a rig, a rack, a cross member, a wall, a column, among others, for example.

Referring to FIG. 10, the pull up bar 101 can be coupled with the left support assembly 102 and the right support assembly 103.

In this embodiment, the pull up bar 101 can be coupled with the left support assembly 102 and the right support assembly 103 in a set of three different locations. The set of three different locations can enable the pull up bar 101 to be located at a working height appropriate for a person performing an exercise, based on a height of a person, and for a type of exercise being performed. Being able to easily change the working height of the pull up bar 101 can enable the person to perform exercises without a step up device, such as a foam pad, a wooden box, among others, for example.

Figure 12:
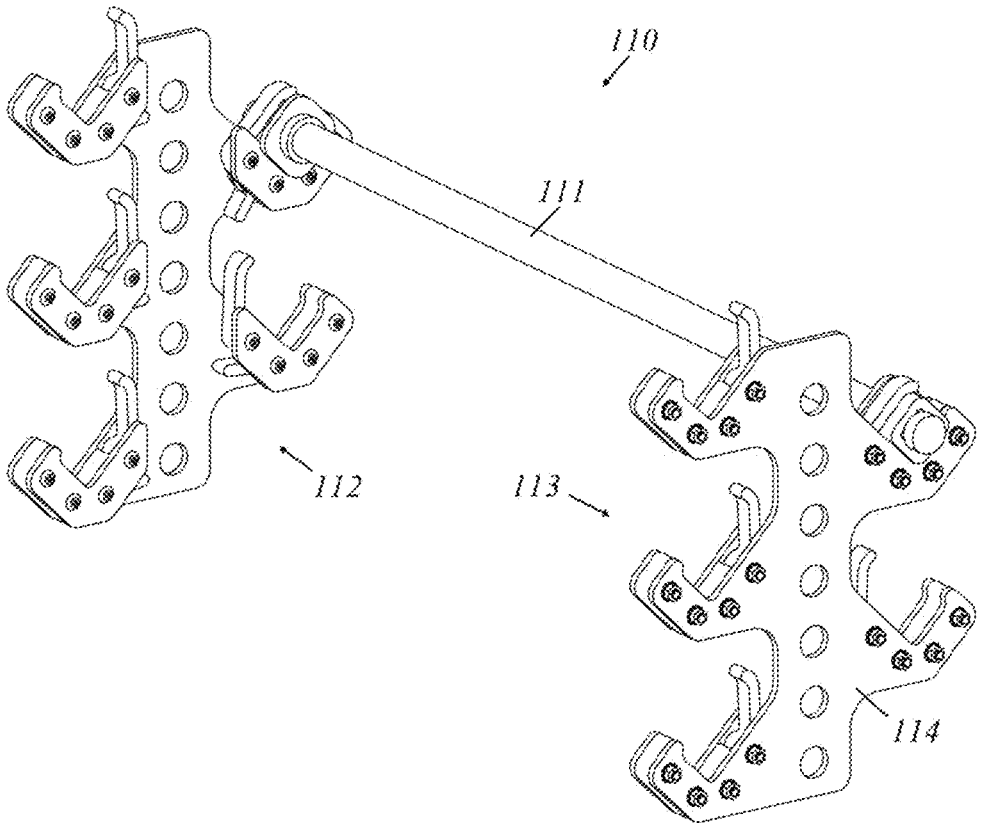
FIG. 12 is a perspective view of a pull up bar system incorporating a shock absorbing mount according to an embodiment of the present disclosure.
Figure 13:
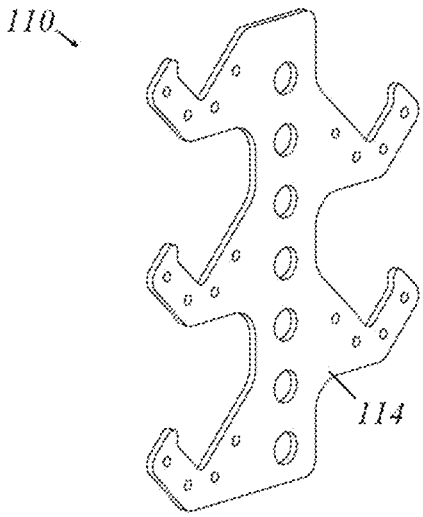
FIG. 13 is a perspective view of the right support bracket of the pull up bar system of FIG. 12, according to an embodiment of the present disclosure.

FIG. 12 is a perspective view of a pull up bar system incorporating a shock absorbing mount according to an embodiment of the present disclosure. FIG. 13 is a perspective view of the right support bracket 114 of the right support assembly 113 of the pull up bar system 110 of FIG. 12, according to an embodiment of the present disclosure.

A pull up bar system 110 can include a pull up bar 111, a left support assembly 112, and a right support assembly 113. The right support assembly 113 can include a right support bracket 114. The right support bracket 114 of FIG. 12 is shown in a perspective view in FIG. 13.

The left support assembly 112 and the right support assembly 113 can be attachable to an outside surface, such as, but not necessarily limited to, a rig, a rack, a cross member, a wall, a column, among others, for example.

Referring to FIG. 12, the pull up bar 111 can be coupled with the left support assembly 112 and the right support assembly 113.

In this embodiment, the pull up bar 111 can be coupled with the left support assembly 112 and the right support assembly 113 in a set of five different locations. The set of five different locations can enable the pull up bar 111 to be located at a working height appropriate for a person performing an exercise, based on a height of a person, and for a type of exercise being performed. Being able to easily change the working height of the pull up bar 111 can enable the person to perform exercises without a step up device, such as a foam pad, a wooden box, among others, for example.

Figure 14:
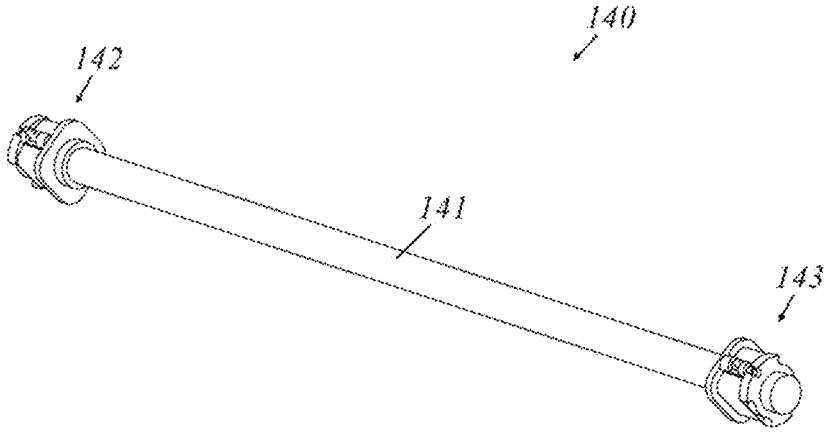
FIG. 14 is a perspective view of a pull up bar system incorporating a shock absorbing mount according to an embodiment of the present disclosure.

FIG. 14 is a perspective view of a pull up bar system incorporating a shock absorbing mount according to an embodiment of the present disclosure.

A pull up bar system 140 can include a pull up bar 141, a left elastomer mount assembly 142 and a right elastomer mount assembly 143.

A left end of the pull up bar 141 can be coupled with the left elastomer mount assembly 142. A right end of the pull up bar 141 can be coupled with the right elastomer mount assembly 143. In this embodiment, the pull up bar 141 can be restricted from rotating relative to the elastomer mount assemblies 142, 143.

Figure 15:
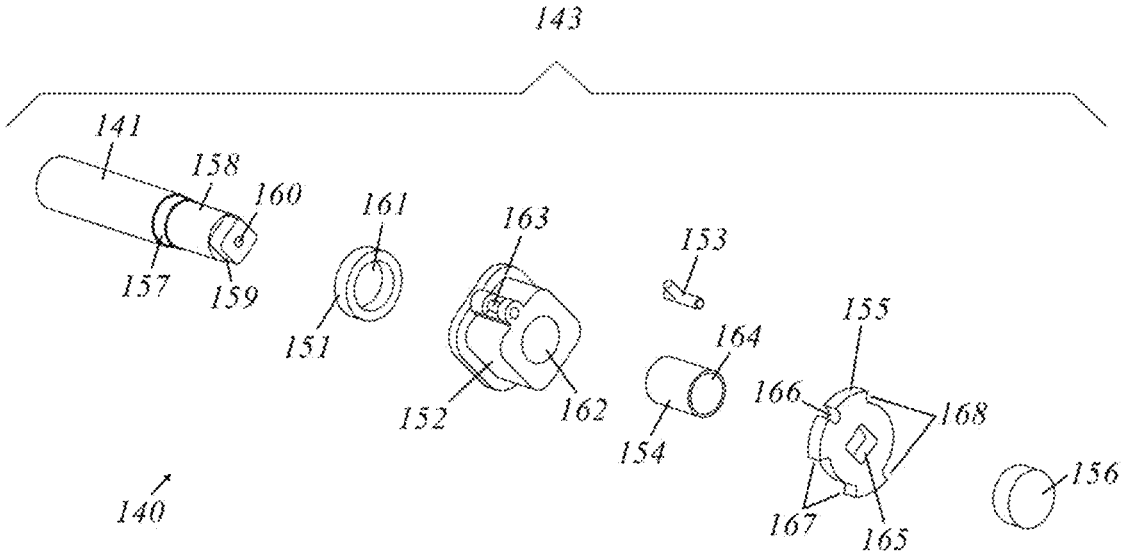
FIG. 15 is an exploded perspective view of a right side portion of the pull up bar system of FIG. 14, according to an embodiment of the present disclosure.
Figure 16:
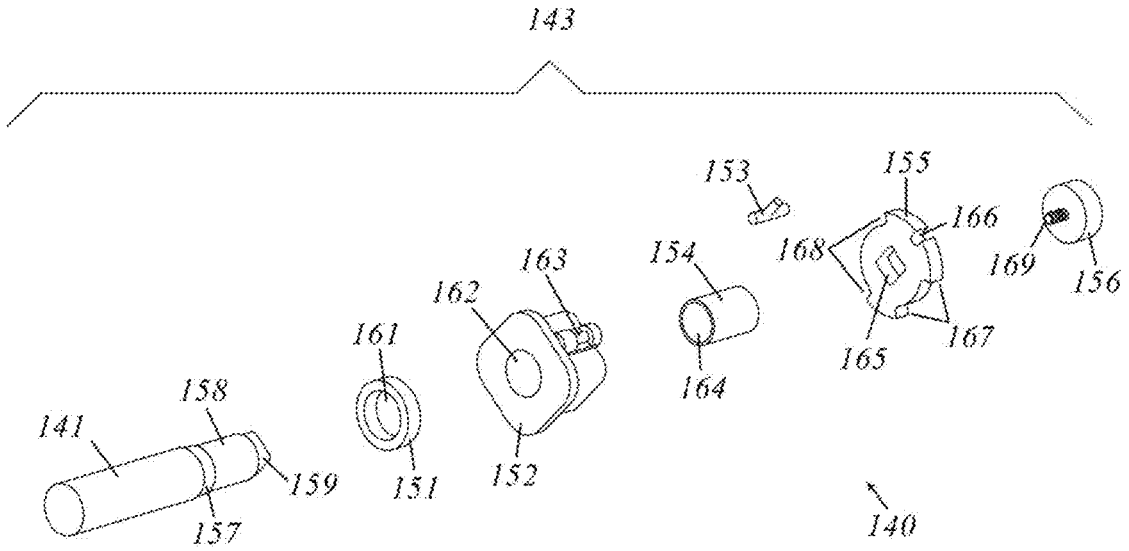
FIG. 16 is an exploded perspective view of a right side portion of the pull up bar system of FIG. 14, according to an embodiment of the present disclosure.

FIG. 15 is an exploded perspective view of a right side portion of the pull up bar system 140 of FIG. 14, according to an embodiment of the present disclosure. FIG. 16 is another exploded perspective view of a right side portion of the pull up bar system 140 of FIG. 14, according to an embodiment of the present disclosure.

The pull up bar system 140 can include a collar 151, an elastomer block 152, an index plunger 153, a bearing (or bushing) 154, a hub 155, and a thumbscrew fastener 156. The right end of the pull up bar 141 can include an area 157, an area 158, an area 159, and a threaded hole 160. The collar 151 can include an opening 161. The elastomer block 152 can include an opening 162 and an index plunger area 163. The bearing 154 can include an opening 164. The hub 155 can include an opening 165, an open notch area 166, an open notch area 167, and an open notch area 168.

The index plunger 153 can be slidably extended into the index plunger area 163 of the elastomer block 152. The bearing 154 can be slidably extended into the opening 162 of the elastomer block 152.

The right end of the pull up bar 141 can be slidably extended through the opening 161 of the collar 151. The collar 151 can be coupled to the area 157 of the pull up bar 141.

The right end of the pull up bar 141 can be slidably extended through the opening 164 of the bearing 154. The bearing 154 and the elastomer block 152 can be coupled to the area 158 of the pull up bar 141.

The right end of the pull up bar 141 can be slidably extended through the opening 165 of the hub 155. The hub 155 can be coupled to the area 159 of the pull up bar 141. The thumbscrew fastener 156 can be threaded into the threaded hole 160 of the pull up bar 141. The hub 155 can couple the pull up bar 141 with the bearing 154 and the elastomer block 152 to restrict lateral movement of the pull up bar 141 relative to the bearing 154 and the elastomer block 152. Optionally, the index plunger 153 can be slidably extended into each of the open notch areas 166, 167, 168 to restrict rotational movement of the pull up bar 141 in the bearing 154 and the elastomer block 152. The open notch area 166 can restrict rotation of the pull up bar 141 to zero degrees of rotation. The open notch area 167 can restrict rotation of the pull up bar 141 to 60 degrees of rotation. The open notch area 168 can restrict rotation of the pull up bar 141 to 120 degrees of rotation. The amount of rotation restricted by the hub 155 can be determined by the circumferential distance or arc distance of the open notch area to provide a specified degree of rotation.

The thumbscrew fastener 156 can include an external threaded portion 169.

Figure 17:
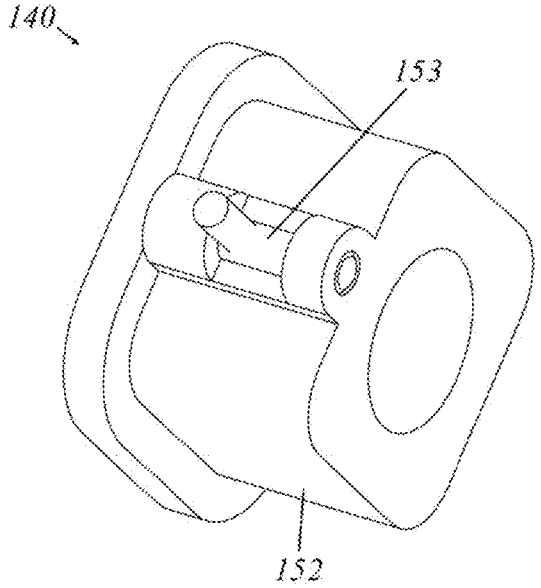
FIG. 17 is a perspective view of a right side portion of the pull up bar system of FIG. 14, according to an embodiment of the present disclosure.

FIG. 17 is a perspective view of a right side portion of the pull up bar system 140 of FIG. 14, according to an embodiment of the present disclosure. Referring to FIG. 17, the index plunger 153 can be in a retracted position relative to the elastomer block 152.

Figure 18:
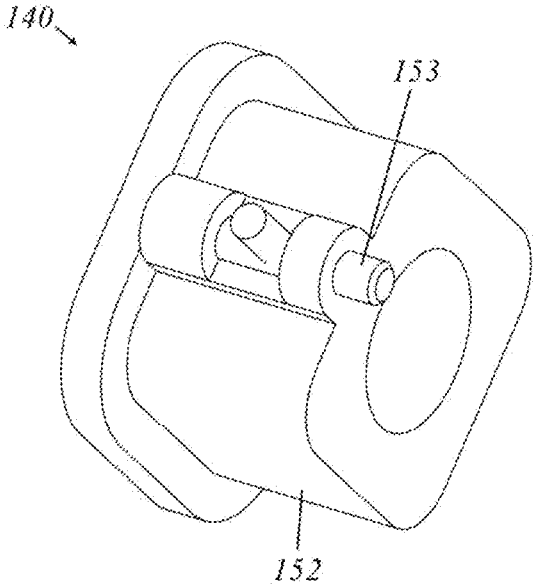
FIG. 18 is a perspective view of a right side portion of the pull up bar system of FIG. 14, according to an embodiment of the present disclosure.

FIG. 18 is a perspective view of a right side portion of the pull up bar system 140 of FIG. 14, according to an embodiment of the present disclosure. Referring to FIG. 18, the index plunger 153 can be in an extended position relative to the elastomer block 152.

Figure 19:
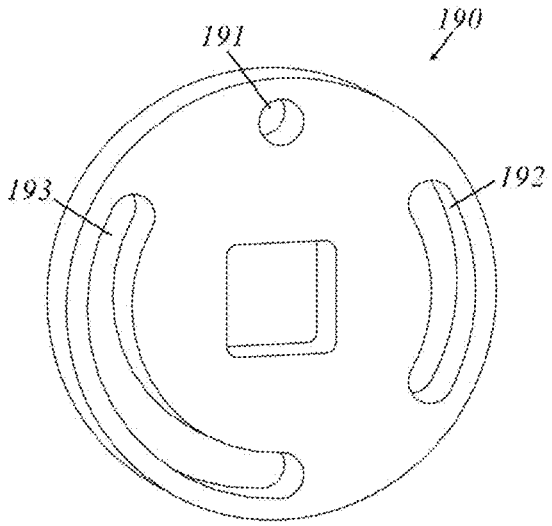
FIG. 19 is a perspective view of a hub according to an embodiment of the present disclosure.

FIG. 19 is a perspective view of another embodiment of a hub compared to the hub 155 in FIGS. 15-16 according to an embodiment of the present disclosure. Possible hub shapes are not necessarily limited to these examples.

A hub 190 can include an opening 191, an opening 192, and an opening 193, for example. The opening 191 can restrict rotation to zero degrees of rotation. The opening 192 can restrict rotation to 60 degrees of rotation. The opening 193 can restrict rotation to 120 degrees of rotation.

Figure 20:
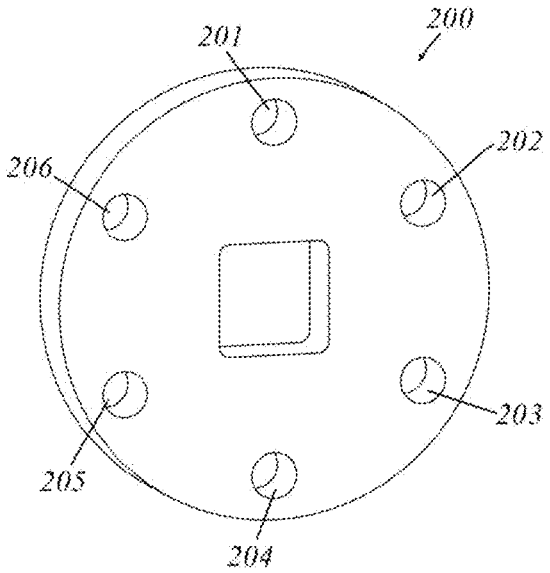
FIG. 20 is a perspective view of a hub according to an embodiment of the present disclosure.

FIG. 20 is a perspective view of another embodiment of a hub compared to the hub 155 in FIGS. 15-16 according to an embodiment of the present disclosure. Possible hub shapes are not necessarily limited to these examples.

A hub 200 can include an opening 201, an opening 202, an opening 203, an opening 204, an opening 205, and an opening 206. Each of the openings 201-206 can restrict rotation to zero degrees of rotation.

Figure 21:
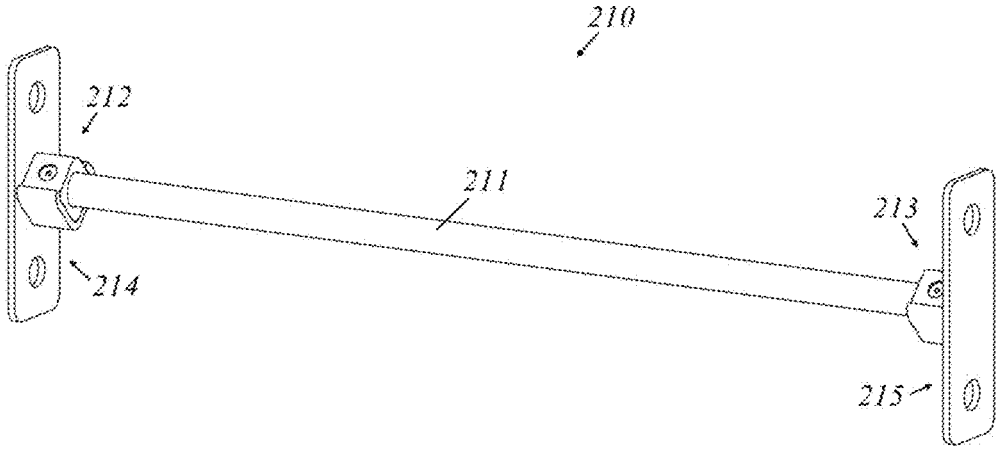
FIG. 21 is a perspective view of a pull up bar system incorporating a shock absorbing mount according to an embodiment of the present disclosure.

FIG. 21 is a perspective view of a pull up bar system incorporating a shock absorbing mount according to an embodiment of the present disclosure.

A pull up bar system 210 can include a pull up bar 211, a left elastomer mount assembly 212, a right elastomer mount assembly 213, a left support assembly 214, and a right support assembly 215.

Each of the left support assembly 214 and the right support assembly 215, can be attachable to an outside surface, such as, but not necessarily limited to, a rig, a rack, a cross member, a wall, a column, among others, for example.

A left end of the pull up bar 211 can be coupled with the left elastomer mount assembly 212. A right end of the pull up bar 211 can be coupled with the right elastomer mount assembly 213. In this embodiment, the pull up bar 211 can be restricted from rotating relative to the elastomer mount assemblies 212, 213.

Referring to FIG. 21, the left elastomer mount assembly 212 can be coupled with the left support assembly 214, and the right elastomer mount assembly 213 can be coupled with the right support assembly 215. In this embodiment, the elastomer mount assemblies 212, 213 can be coupled to the support assemblies 214, 215, in each of four rotational positions.

Figure 22:
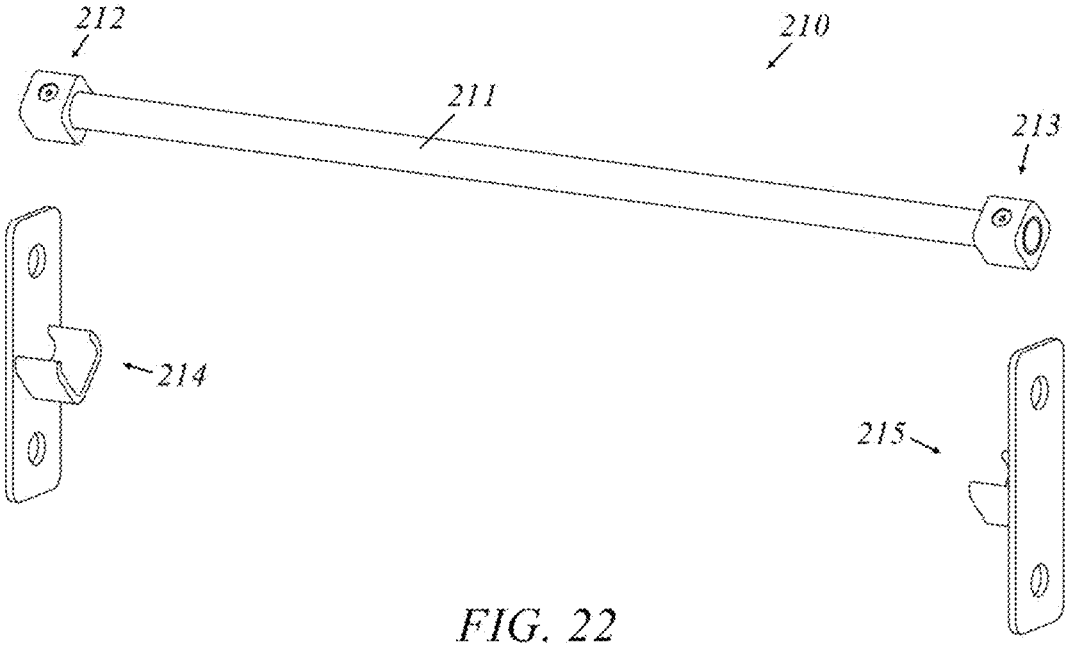
FIG. 22 is an exploded perspective view of the pull up bar system of FIG. 21, according to an embodiment of the present disclosure.

FIG. 22 is an exploded perspective view of the pull up bar system 210 of FIG. 21, according to an embodiment of the present disclosure.

Referring to FIG. 22, the left elastomer mount assembly 212 can be uncoupled from the left support assembly 214, and the right elastomer mount assembly 213 can be uncoupled from the right support assembly 215.

Figure 23:
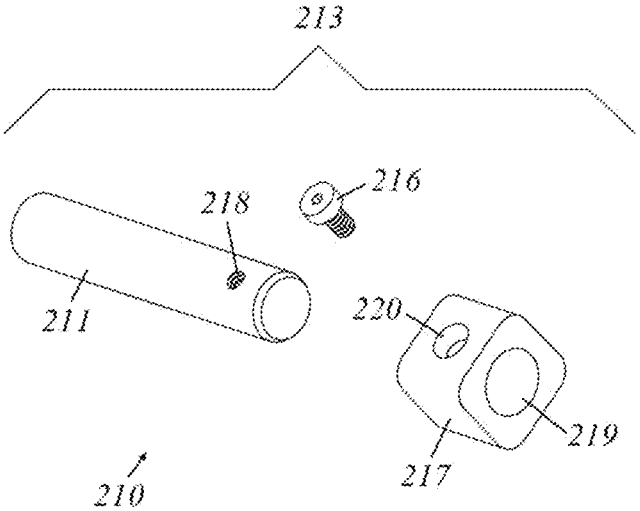
FIG. 23 is an exploded perspective view of a right side portion of the pull up bar system of FIG. 21, according to an embodiment of the present disclosure.
Figure 24:
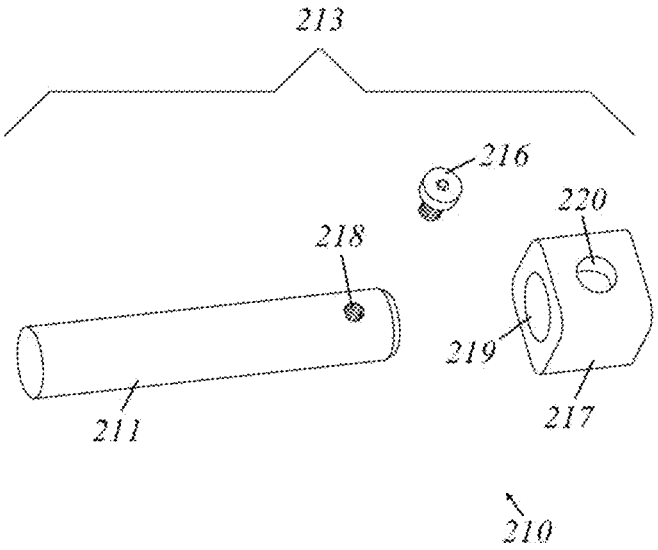
FIG. 24 is an exploded perspective view of a right side portion of the pull up bar system of FIG. 21, according to an embodiment of the present disclosure.

FIG. 23 is an exploded perspective view of a right side portion of the pull up bar system 210 of FIG. 21, according to an embodiment of the present disclosure. FIG. 24 is another exploded perspective view of a right side portion of the pull up bar system 210 of FIG. 21, according to an embodiment of the present disclosure.

The pull up bar system 210 can include a threaded screw fastener 216 and an elastomer block 217. The right end of the pull up bar 211 can include a threaded hole 218. The elastomer block 217 can include an opening 219 and an opening 220.

The right end of the pull up bar 211 can be slidably extended through the opening 219 of the elastomer block 217. The opening 220 of the elastomer block 217 can be aligned axially with the threaded hole 218 of the pull up bar 211. The threaded fastener 216 can be slidably extended through the opening 220 and threaded into the threaded hole 218. The threaded fastener 216 can couple the pull up bar 211 with the elastomer block 217 to restrict lateral movement and restrict rotational movement of the pull up bar 211 relative to the elastomer block 217.

Figure 25:
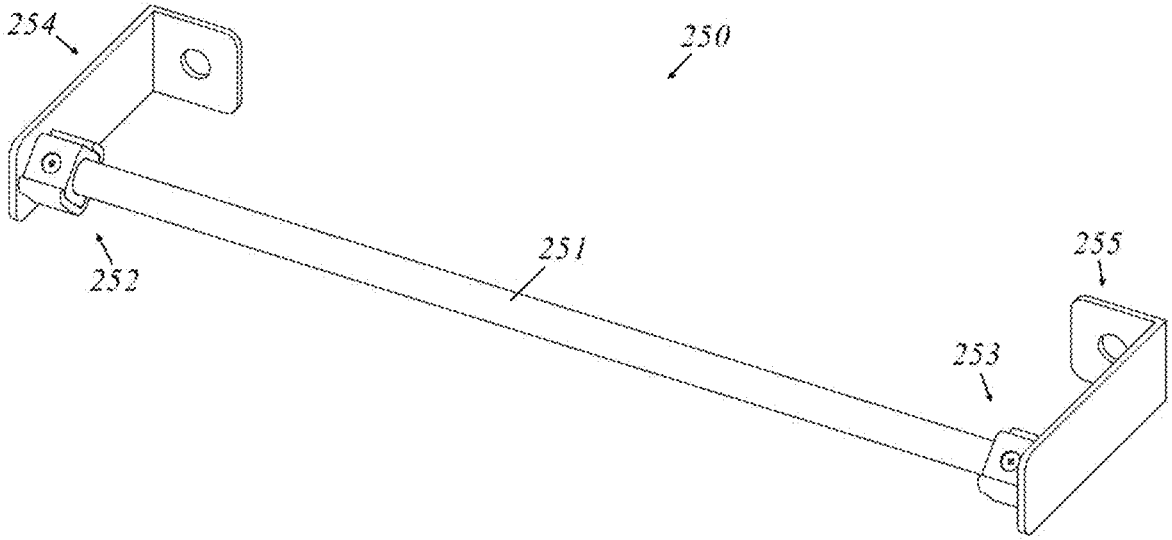
FIG. 25 is a perspective view of a pull up bar system incorporating a shock absorbing mount according to an embodiment of the present disclosure.

FIG. 25 is a perspective view of a pull up bar system incorporating a shock absorbing mount according to an embodiment of the present disclosure.

A pull up bar system 250 can include a pull up bar 251, a left elastomer mount assembly 252, a right elastomer mount assembly 253, a left support assembly 254, and a right support assembly 255.

Each of the left support assembly 254 and the right support assembly 255, can be attachable to an outside surface, such as, but not necessarily limited to, a rig, a rack, a cross member, a wall, a column, among others, for example.

A left end of the pull up bar 251 can be coupled with the left elastomer mount assembly 252. A right end of the pull up bar 251 can be coupled with the right elastomer mount assembly 253. In this embodiment, the pull up bar 251 can be restricted from rotating relative to the elastomer mount assemblies 252, 253.

Referring to FIG. 25, the left elastomer mount assembly 252 can be coupled with the left support assembly 254, and the right elastomer mount assembly 253 can be coupled with the right support assembly 255. In this embodiment, the elastomer mount assemblies 252, 253 can be coupled to the support assemblies 254, 255, in each of four rotational positions.

In some embodiments of the present disclosure, aside from the elastomer members for shock absorption, the components can be made from any suitable metal, including but not necessarily limited to, steel, stainless steel, chromed steel, aluminum, titanium, alloys thereof, or any combination thereof, for example. Although elastomer material has been illustrated in the example embodiments shown and discussed relating to FIGS. 1-25, in other embodiments alterative shock absorbing materials or shock absorbing non-metal material can be substituted or combined therewith, including (but not necessarily limited to): elastomer, plastic, thermoplastic elastomers (TPE), thermoplastic polyurethane (TPU), urethane, silicone, polyurethane (PU), ethylene propylene diene monomer (EPGM), natural rubber, synthetic rubber, metal composites thereof, composites thereof, or any combination thereof, for example.

More example embodiments of the present disclosure are summarized here. Other embodiments can also be understood from the entirety of the specification as well as the claims filed herein.

Example 1. An exercise system including: a bar having a first bar end and a second bar end; a first block coupled to the first bar end, the first block containing a first shock absorbing non-metal material; a first support bracket; and a first u-shaped latch assembly protruding from the first support bracket, where the first u-shaped latch assembly is configured to at least partially mate with the first block such that when the first block slidably fits into the first u-shaped latch assembly, the first block is restricted from rotating within the first u-shaped latch assembly.

Example 2. The system of example 1, further including: a second block coupled to the second bar end, the second block containing a second shock absorbing non-metal material; a second support bracket; and a second u-shaped latch assembly protruding from the second support bracket, where the second u-shaped latch assembly is configured to at least partially mate with the second block such that when the second block slidably fits into the second u-shaped latch assembly, the second block is restricted from rotating within the second u-shaped latch assembly.

Example 3. The system of one of examples 1 or 2, where each of the first support bracket and the second support bracket has at least one attachment hole therein; where the first block is fixedly coupled to the bar such that the bar is fixed relative to the first block; where the second block is fixedly coupled to the bar such that the bar is fixed relative to the second block; and where each of the first block and the second block is entirely made of an elastomer material.

Example 4. The system of one of examples 1 to 3, further including: a first hub; a first collar; and a first threaded fastener, where the first block is sandwiched between the first hub and the first collar at the first bar end, where the first bar end includes a first threaded hole, and where the first threaded fastener is threaded into the first threaded hole to secure the first block to the first bar end.

Example 5. The system of one of examples 1 to 4, where the first block has a generally rectangular shape with four flat sides and rounded corners; where the first block has a first generally square hole on one end thereof; where the first hub has a first generally square shape with a second generally square hole therein, where the first generally square shape of the first hub fits into the first generally square hole of the first block; where the first bar end has a second generally square shape, where the first generally square shape is larger than the second generally square shape, where the second generally square shape of the first bar end fits into the second generally square hole of the first hub; where the first threaded fastener has an outer dimension larger than the second generally square hole such that the first threaded fastener presses against the first hub; where the first block is entirely made of an elastomer material; and where each of the bar, the first support bracket, the first u-shaped latch assembly, the first hub, the first collar, and the first threaded fastener is made of metal.

Example 6. The system of one of examples 1 to 5, further including: a first hub; a first collar; a first threaded fastener; and a first bearing, where the first block includes a first bearing hole therein, such that the first bearing is inserted into the first bearing hole, where the first block and the first bearing are sandwiched between the first hub and the first collar at the first bar end, where the first bar end includes a first threaded hole, and where the first threaded fastener is threaded into the first threaded hole, such that the first block is rotatably coupled to the first bar end.

Example 7. The system of one of examples 1 to 6, where the first block has a generally rectangular shape with four flat sides and rounded corners; where the first hub has a first generally round shape with a first generally square hole therein; where the first bar end has a first generally square shape, where the first generally square shape of the first bar end fits into the first generally square hole of the first hub; where the first threaded fastener has an outer dimension larger than the first generally square hole such that the first threaded fastener presses against the first hub; where the first block is entirely made of an elastomer material; and where each of the bar, the first support bracket, the first u-shaped latch assembly, the first hub, the first collar, and the first threaded fastener is made of metal.

Example 8. The system of one of examples 1 to 7, further including a first bar rotation index pin, where the first bar rotation index pin is attached to the first block on one side thereof.

Example 9. The system of one of examples 1 to 8, where the first hub includes a first bar rotation index notch concentric about the first bar end, and where the first bar rotation index notch is configured to receive insertion of a first bar rotation index pin therein to restrict a rotational movement of the first hub relative to the first block within a range of rotational movement corresponding to an angular range of the first bar rotation index notch.

Example 10. The system of one of examples 1 to 9, where the first hub includes a first bar rotation index slot concentric about the first bar end, and where the first bar rotation index slot is configured to receive insertion of a first bar rotation index pin therein to restrict a rotational movement of the first hub relative to the first block within a range of rotational movement corresponding to an angular range of the first bar rotation index slot.

Example 11. The system of one of examples 1 to 10, where the first hub includes a set of first bar rotation index pin holes configured to provide multiple options for inserting a first bar rotation index pin to restrict a rotational movement of the first hub relative to the first block.

Example 12. The system of one of examples 1 to 11, where the first block has a generally rectangular shape with four flat sides and rounded corners.

Example 13. The system of one of examples 1 to 12, where the first block is entirely made of an elastomer material, and where each of the bar, the first support bracket, and the first u-shaped latch assembly is made of metal.

Example 14. The system of one of examples 1 to 13, where the first u-shaped latch assembly includes an over-center mechanism with a retaining mechanism configured to retain the over-center mechanism in a closed position when the first block is inserted into the first u-shaped latch assembly; where the retaining mechanism includes a hook shaped member, a lever member, a spring pivot member, and a spring member; where the lever member is configured to couple with the hook shaped member and the spring pivot member; and where the spring presses against the spring pivot member such that the latch assembly can retain a closed position.

Example 15. The system of one of examples 1 to 14, where the first u-shaped latch assembly includes an over-center mechanism with a retaining mechanism configured to retain the over-center mechanism in an open position; where the retaining mechanism includes a hook shaped member, a lever member, a spring pivot member, and a spring member; where the lever member is configured to couple with the hook shaped member and the spring pivot member; and where the spring presses against the spring pivot member such that the latch assembly can retain an open position.

Example 16. An exercise system including: a bar having a first-side bar end and a second-side bar end; a first-side block coupled to the first-side bar end, the first-side block containing a shock absorbing non-metal material; a first-side support bracket; a first first-side u-shaped latch assembly protruding from the first-side support bracket, where the first first-side u-shaped latch assembly is configured to at least partially mate with the first-side block such that when the first-side block slidably fits into the first first-side u shaped latch assembly, the first-side block is restricted from rotating within the first first-side u-shaped latch assembly; and a second first-side u-shaped latch assembly protruding from the first-side support bracket, where the second first-side u-shaped latch assembly is configured to at least partially mate with the first-side block such that when the first-side block slidably fits into the second first-side u-shaped latch assembly, the first-side block is restricted from rotating within the second first-side u-shaped latch assembly.

Example 17. The system of example 16, where the first-side block has a generally rectangular shape with four flat sides and rounded corners; where the first-side block is entirely made of an elastomer material; and where each of the bar, the first-side support bracket, the first first-side u-shaped latch assembly, and the second first-side u-shaped latch assembly is made of metal.

Example 18. The system of one of examples 16 or 17, further including a third first-side u-shaped latch assembly protruding from the first-side support bracket, where the third first-side u-shaped latch assembly is configured to at least partially mate with the first-side block such that when the first-side block slidably fits into the third first-side u-shaped latch assembly, the first-side block is restricted from rotating within the third first-side u-shaped latch assembly.

Example 19. The system of one of examples 16 to 18, further including: a fourth first-side u-shaped latch assembly protruding from the first-side support bracket, where the fourth first-side u-shaped latch assembly is configured to at least partially mate with the first-side block such that when the first-side block slidably fits into the fourth first-side u-shaped latch assembly, the first-side block is restricted from rotating within the fourth first-side u-shaped latch assembly; and a fifth first-side u-shaped latch assembly protruding from the first-side support bracket, where the fifth first-side u-shaped latch assembly is configured to at least partially mate with the first-side block such that when the first-side block slidably fits into the fifth first-side u-shaped latch assembly, the first-side block is restricted from rotating within the fifth first-side u-shaped latch assembly.

Example 20. An exercise system including: a bar having a first bar end and a second bar end; a first block coupled to the first bar end, the first block containing a shock absorbing non-metal material; a first support bracket; and a first u-shaped pocket member protruding from the first support bracket, where the first u-shaped pocket member is configured to at least partially mate with the first block such that when the first block slidably fits into the first u-shaped pocket member, the first block is restricted from rotating within the first u-shaped pocket member.

Example 21. The system of example 20, further including: a second block coupled to the second bar end; a second support bracket; and a second u-shaped pocket member protruding from the second support bracket, where the second u-shaped pocket member is configured to at least partially mate with the second block such that when the second block slidably fits into the second u-shaped pocket member, the second block is restricted from rotating within the second u-shaped pocket member.

Example 22. The system of one of examples 20 or 21, where each of the first support bracket and the second support bracket has at least one attachment hole therein; where the first block is fixed coupled to the bar such that the bar is fixed relative to the first block; where the second block is fixed coupled to the bar such that the bar is fixed relative to the second block; and where each of the first block and the second block is entirely made of an elastomer material.

Example 23. The system of one of examples 20 to 22, where the first block is entirely made of an elastomer material, and where each of the bar, the first support bracket, and the first u-shaped pocket member is made of metal.

Example 24. The system of one of examples 20 to 23, where the first block has a first screw hole therein and a first bar hole therein, such that the first screw hole intersects with the first bar hole, and such that the first bar end is inserted into the first bar hole, where the first bar end has a first threaded hole therein, and where the system further includes a first metal screw inserted into the first screw hole of the first block and threaded into the first threaded hole to secure the first block to the first bar end of the bar.

While the present disclosure has been described with reference to illustrative example embodiments, this description is not intended to necessarily be construed in a limiting sense. Various modifications and combinations of the illustrative embodiments and components thereof, as well as other embodiments, can be apparent to persons skilled in the art upon reference to the description. It is therefore intended that the appended claims encompass any such modifications, equivalents, and embodiments.

The invention claimed is:

1. An exercise system comprising:

a bar having a first bar end and a second bar end;

a first block coupled to the first bar end, the first block containing a first shock absorbing non-metal material;

a first support bracket; and a first u-shaped latch assembly protruding from the first support bracket, wherein the first u-shaped latch assembly is configured to at least partially mate with the first block such that when the first block slidably fits into the first u-shaped latch assembly, the first block is restricted from rotating within the first u-shaped latch assembly.

2. The exercise system of claim 1, further comprising:

a second block coupled to the second bar end, the second block containing a second shock absorbing non-metal material;

a second support bracket; and a second u-shaped latch assembly protruding from the second support bracket, wherein the second u-shaped latch assembly is configured to at least partially mate with the second block such that when the second block slidably fits into the second u-shaped latch assembly, the second block is restricted from rotating within the second u-shaped latch assembly.

3. The exercise system of claim 2, wherein each of the first support bracket and the second support bracket has at least one attachment hole therein;

wherein the first block is fixedly coupled to the bar such that the bar is fixed relative to the first block;

wherein the second block is fixedly coupled to the bar such that the bar is fixed relative to the second block; and wherein each of the first block and the second block is entirely made of an elastomer material.

4. The exercise system of claim 1, further comprising:

a first hub;

a first collar; and a first threaded fastener, wherein the first block is sandwiched between the first hub and the first collar at the first bar end, wherein the first bar end includes a first threaded hole, and wherein the first threaded fastener is threaded into the first threaded hole to secure the first block to the first bar end.

5. The exercise system of claim 4, wherein the first block has a generally rectangular shape with four flat sides and rounded corners;

wherein the first block has a first generally square hole on one end thereof;

wherein the first hub has a first generally square shape with a second generally square hole therein, wherein the first generally square shape of the first hub fits into the first generally square hole of the first block;

wherein the first bar end has a second generally square shape, wherein the first generally square shape is larger than the second generally square shape, wherein the second generally square shape of the first bar end fits into the second generally square hole of the first hub;

wherein the first threaded fastener has an outer dimension larger than the second generally square hole such that the first threaded fastener presses against the first hub;

wherein the first block is entirely made of an elastomer material; and wherein each of the bar, the first support bracket, the first u-shaped latch assembly, the first hub, the first collar, and the first threaded fastener is made of metal.

6. The exercise system of claim 1, further comprising:

a first hub;

a first collar;

a first threaded fastener; and a first bearing, wherein the first block includes a first bearing hole therein, such that the first bearing is inserted into the first bearing hole, wherein the first block and the first bearing are sandwiched between the first hub and the first collar at the first bar end, wherein the first bar end includes a first threaded hole, and wherein the first threaded fastener is threaded into the first threaded hole, such that the first block is rotatably coupled to the first bar end.

7. The exercise system of claim 6, wherein the first block has a generally rectangular shape with four flat sides and rounded corners;

wherein the first hub has a first generally round shape with a first generally square hole therein;

wherein the first bar end has a first generally square shape, wherein the first generally square shape of the first bar end fits into the first generally square hole of the first hub;

wherein the first threaded fastener has an outer dimension larger than the first generally square hole such that the first threaded fastener presses against the first hub;

wherein the first block is entirely made of an elastomer material; and wherein each of the bar, the first support bracket, the first u-shaped latch assembly, the first hub, the first collar, and the first threaded fastener is made of metal.

8. The exercise system of claim 7, further comprising a first bar rotation index pin, wherein the first bar rotation index pin is attached to the first block on one side thereof.

9. The exercise system of claim 8, wherein the first hub includes a first bar rotation index notch concentric about the first bar end, and wherein the first bar rotation index notch is configured to receive insertion of the first bar rotation index pin therein to restrict a rotational movement of the first hub relative to the first block within a range of rotational movement corresponding to an angular range of the first bar rotation index notch.

10. The exercise system of claim 8, wherein the first hub includes a first bar rotation index slot concentric about the first bar end, and wherein the first bar rotation index slot is configured to receive insertion of the first bar rotation index pin therein to restrict a rotational movement of the first hub relative to the first block within a range of rotational movement corresponding to an angular range of the first bar rotation index slot.

11. The exercise system of claim 8, wherein the first hub includes a set of first bar rotation index pin holes configured to provide multiple options for inserting the first bar rotation index pin to restrict a rotational movement of the first hub relative to the first block.

12. The exercise system of claim 1, wherein the first block has a generally rectangular shape with four flat sides and rounded corners.

13. The exercise system of claim 1, wherein the first block is entirely made of an elastomer material, and wherein each of the bar, the first support bracket, and the first u-shaped latch assembly is made of metal.

14. The exercise system of claim 1, wherein the first u-shaped latch assembly includes an over-center mechanism with a retaining mechanism configured to retain the over-center mechanism in a closed position when the first block is inserted into the first u-shaped latch assembly;

wherein the retaining mechanism includes a hook shaped member, a lever member, a spring pivot member, and a spring member;

wherein the lever member is configured to couple with the hook shaped member and the spring pivot member; and wherein the spring member presses against the spring pivot member such that the latch assembly can retain the closed position.

15. The exercise system of claim 1, wherein the first u-shaped latch assembly includes an over-center mechanism with a retaining mechanism configured to retain the over-center mechanism in an open position;

wherein the retaining mechanism includes a hook shaped member, a lever member, a spring pivot member, and a spring member;

wherein the lever member is configured to couple with the hook shaped member and the spring pivot member; and wherein the spring member presses against the spring pivot member such that the latch assembly can retain the open position.

16. An exercise system comprising:

a bar having a first-side bar end and a second-side bar end;

a first-side block coupled to the first-side bar end, the first-side block containing a shock absorbing non-metal material;

a first-side support bracket;

a first first-side u-shaped latch assembly protruding from the first-side support bracket, wherein the first first-side u-shaped latch assembly is configured to at least partially mate with the first-side block such that when the first-side block slidably fits into the first first-side u shaped latch assembly, the first-side block is restricted from rotating within the first first-side u-shaped latch assembly; and a second first-side u-shaped latch assembly protruding from the first-side support bracket, wherein the second first-side u-shaped latch assembly is configured to at least partially mate with the first-side block such that when the first-side block slidably fits into the second first-side u-shaped latch assembly, the first-side block is restricted from rotating within the second first-side u-shaped latch assembly.

17. The exercise system of claim 16, wherein the first-side block has a generally rectangular shape with four flat sides and rounded corners;

wherein the first-side block is entirely made of an elastomer material; and wherein each of the bar, the first-side support bracket, the first first-side u-shaped latch assembly, and the second first-side u-shaped latch assembly is made of metal.

18. The exercise system of claim 16, further comprising a third first-side u-shaped latch assembly protruding from the first-side support bracket, wherein the third first-side u-shaped latch assembly is configured to at least partially mate with the first-side block such that when the first-side block slidably fits into the third first-side u-shaped latch assembly, the first-side block is restricted from rotating within the third first-side u-shaped latch assembly.

19. The exercise system of claim 18, further comprising:

a fourth first-side u-shaped latch assembly protruding from the first-side support bracket, wherein the fourth first-side u-shaped latch assembly is configured to at least partially mate with the first-side block such that when the first-side block slidably fits into the fourth first-side u-shaped latch assembly, the first-side block is restricted from rotating within the fourth first-side u-shaped latch assembly; and a fifth first-side u-shaped latch assembly protruding from the first-side support bracket, wherein the fifth first-side u-shaped latch assembly is configured to at least partially mate with the first-side block such that when the first-side block slidably fits into the fifth first-side u-shaped latch assembly, the first-side block is restricted from rotating within the fifth first-side u-shaped latch assembly.

20. An exercise system comprising:

a bar having a first bar end and a second bar end;

a first block coupled to the first bar end, the first block containing a shock absorbing non-metal material;

a first support bracket; and a first u-shaped pocket member protruding from the first support bracket, wherein the first u-shaped pocket member is configured to at least partially mate with the first block such that when the first block slidably fits into the first u-shaped pocket member, the first block is restricted from rotating within the first u-shaped pocket member.

21. The exercise system of claim 20, further comprising:

a second block coupled to the second bar end;

a second support bracket; and a second u-shaped pocket member protruding from the second support bracket, wherein the second u-shaped pocket member is configured to at least partially mate with the second block such that when the second block slidably fits into the second u-shaped pocket member, the second block is restricted from rotating within the second u-shaped pocket member.

22. The exercise system of claim 21, wherein each of the first support bracket and the second support bracket has at least one attachment hole therein;

wherein the first block is fixedly coupled to the bar such that the bar is fixed relative to the first block;

wherein the second block is fixedly coupled to the bar such that the bar is fixed relative to the second block; and wherein each of the first block and the second block is entirely made of an elastomer material.

23. The exercise system of claim 20, wherein the first block is entirely made of an elastomer material, and wherein each of the bar, the first support bracket, and the first u-shaped pocket member is made of metal.

24. The exercise system of claim 23, wherein the first block has a first screw hole therein and a first bar hole therein, such that the first screw hole intersects with the first bar hole, and such that the first bar end is inserted into the first bar hole, wherein the first bar end has a first threaded hole therein, and wherein the exercise system further comprises a first metal screw inserted into the first screw hole of the first block and threaded into the first threaded hole to secure the first block to the first bar end of the bar.

* * * * *